US012685387B2

(12) United States Patent
Loughney et al.

(10) Patent No.: US 12,685,387 B2
(45) Date of Patent: Jul. 21, 2026

(54) UTILITY BRUSH

(71) Applicant: ULTRAFAB, INC., Farmington, NY (US)

(72) Inventors: David M. Loughney, Phelps, NY (US); Todd M. Clemons, Canandaigua, NY (US); Akira Chanthabandith, Walworth, NY (US)

(73) Assignee: ULTRAFAB, INC., Farmington, NY (US)

( * ) Notice: Subject to any disclaimer, the term of this patent is extended or adjusted under 35 U.S.C. 154(b) by 494 days.

(21) Appl. No.: 18/139,886

(22) Filed: Apr. 26, 2023

(65) Prior Publication Data

US 2024/0074574 A1 Mar. 7, 2024

Related U.S. Application Data

(60) Provisional application No. 63/334,953, filed on Apr. 26, 2022.

(51) Int. Cl.
*A46D 3/04* (2006.01)
*A46B 3/00* (2006.01)
(Continued)

(52) U.S. Cl.
CPC ..... *A46D 3/045* (2013.01); *A46B 3/00* (2013.01); *A46B 3/06* (2013.01); *A46D 9/02* (2013.01); *A46B 2200/30* (2013.01)

(58) Field of Classification Search
CPC .. A46B 3/06; A46B 3/18; A46B 9/065; A46B 1/00; A46B 9/02; A46D 3/045;
(Continued)

(56) References Cited

U.S. PATENT DOCUMENTS 3,354,491 A * 11/1967 Schlegel, Jr. ..... A46B 5/04 15/207.2
3,404,487 A 10/1968 Johnson
(Continued)

FOREIGN PATENT DOCUMENTS

JP 5685775 B2 3/2015

OTHER PUBLICATIONS

Written Opinion of the International Searching Authority, International Patent Application No. PCT/US2023/020085, Jul. 21, 2023.
(Continued)

*Primary Examiner* — Laura C Guidotti
(74) *Attorney, Agent, or Firm* — Kenneth J. LuKacher Law Group; R. S. Rosenholm; Kenneth J. LuKacher

(57) ABSTRACT

The invention provides for an improved article of manufacturing, being a utility brush that is designed to be made from material that minimizes abrasion to surfaces. This brush is made from materials excluding metal and other materials that can cause abrasion to surfaces upon the utility brush making physical contact with those surfaces. The utility brush being further designed to be made of material that excludes adhesives, where adhesives can be vulnerable to decomposition caused by physical contact with chemical solvents that could be applied to the utility brush or to the surfaces. The brush can be further dimensioned and/or customized, to brush surfaces located within oddly dimensioned and/or difficult to access spaces, including small and/or narrow spaces and crevices.

20 Claims, 17 Drawing Sheets

(51) Int. Cl.
*A46B 3/06* (2006.01)
*A46D 9/02* (2006.01)

(58) Field of Classification Search
CPC ... A46D 3/00; A46D 3/04; A46D 3/08; A46D 1/04; D04H 11/00; D04H 11/08
USPC ..... 15/208–210.1, 159.1–160; 300/21
See application file for complete search history.

(56) References Cited

U.S. PATENT DOCUMENTS

| | | | |
|---|---|---|---|
| 3,616,137 | A | 10/1971 | Horton |
| 3,677,851 | A | 7/1972 | Kayser |
| 3,836,421 | A | 9/1974 | Terry, Jr. et al. |
| 3,935,043 | A | 1/1976 | Kessler |
| 4,164,599 | A | 8/1979 | Kessler |
| 4,244,074 | A | 1/1981 | Barcikowski et al. |
| 4,302,494 | A | 11/1981 | Horton |
| 5,338,382 | A | 8/1994 | Johnson et al. |
| 5,447,590 | A | 9/1995 | Gilpatrick |
| 5,472,762 | A | 12/1995 | Edwards et al. |
| 5,807,451 | A | 9/1998 | Johnson |
| 5,846,377 | A | 12/1998 | Frantz et al. |
| 5,906,877 | A | 5/1999 | Popper et al. |
| 6,252,757 | B1 | 6/2001 | Loughney et al. |
| 7,172,006 | B2 | 2/2007 | Day et al. |
| 7,335,412 | B2 | 2/2008 | Wylie |
| 10,251,469 | B2 | 4/2019 | Wilson et al. |
| 10,731,278 | B2 | 8/2020 | Loughney et al. |
| 2007/0014966 | A1 | 1/2007 | Day et al. |
| 2009/0094899 | A1 | 4/2009 | Loughney et al. |
| 2013/0236684 | A1 | 9/2013 | Loughney et al. |
| 2019/0078379 | A1 | 3/2019 | Loughney et al. |
| 2021/0212446 | A1 | 7/2021 | Jungnickel |

OTHER PUBLICATIONS

Printout of U.S. Appl. No. 18/099,693, filed Jan. 20, 2023 with Filing Receipt.
Printout of USPTO Action for U.S. Appl. No. 18/099,693, date mailed Oct. 16, 2025.

* cited by examiner

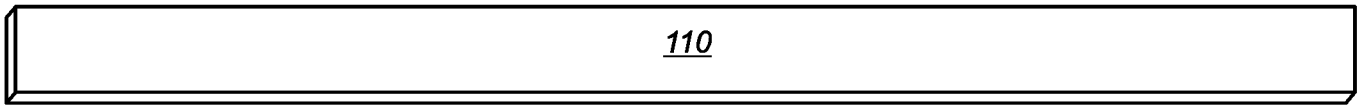
FIG. 1A
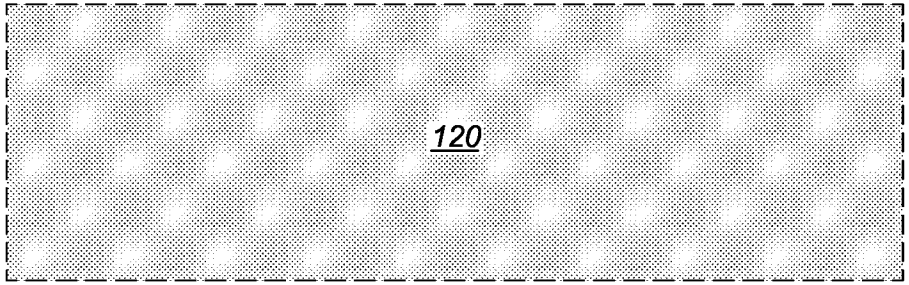
FIG. 1B
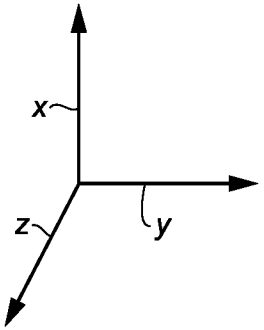

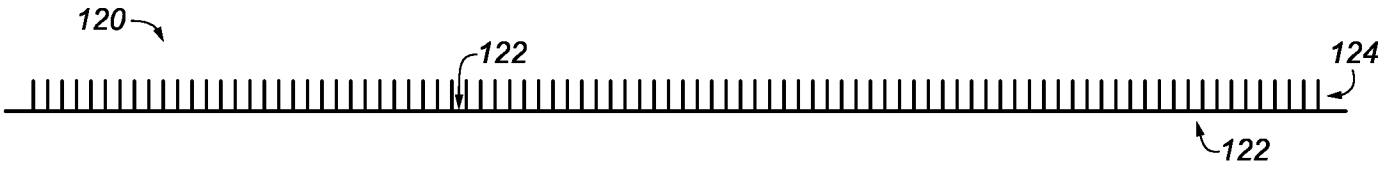
FIG. 1D
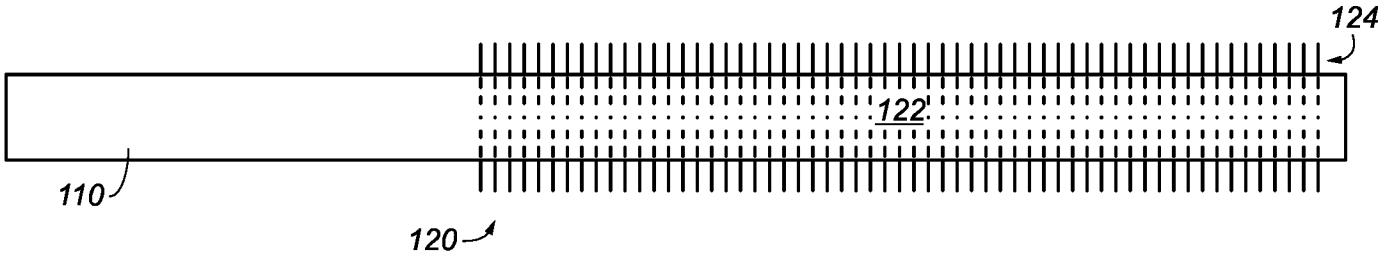
FIG. 1E
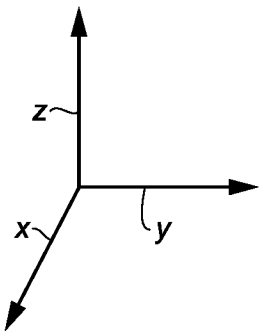

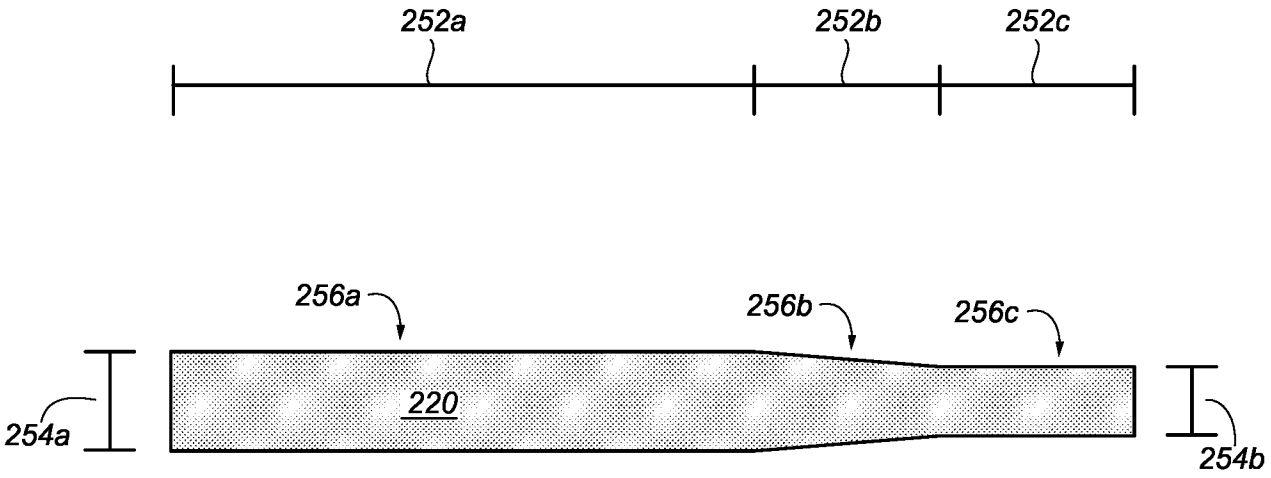
FIG. 2B
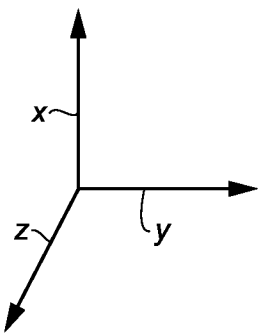

UTILITY BRUSH

This document is a United States Non-Provisional utility patent application being filed under statute 35 U.S.C. 111(a), and that claims priority and benefit to U.S. (utility) provisional patent application having Ser. No. (63/334,953), (Confirmation No. 1180), that was filed on Apr. 26, 2022, and that is entitled "Utility Brush", and which is incorporated herein by reference in its entirety, for any and all purposes.

PATENT APPLICATION(S) INCLUDING RELATED SUBJECT MATTER

This document includes subject matter generally related to U.S. Patent Application Publication No. 2013/0236684 to Loughney et al., that was published Sep. 12, 2013, and includes subject matter generally related to that of U.S. Provisional Patent Application No. 62/556,345 that was filed on Sep. 9, 2017, and includes subject matter generally related to U.S. Non-provisional patent application Ser. No. 16/125,639 that was filed on Sep. 7, 2018, and U.S. Patent Application Publication No. 2019/0078379 to Loughney et al., that was published Mar. 14, 2019. All of the aforementioned patents, patent publications and other publications are herein incorporated by reference in their entirety.

BACKGROUND OF THE INVENTION

Brushes can be designed for various tasks, including brushing, cleaning, scrubbing, scraping or polishing various types of surfaces.

BRIEF DESCRIPTION OF THE INVENTION

The invention provides for an improved article of manufacturing, being a utility brush, that is designed to be made from material that excludes metal and that excludes other types of hard materials that can cause abrasion to surfaces that come into contact with the utility brush. The utility brush being further designed to be made of material that excludes adhesives, which can be vulnerable to chemical decomposition caused by physical contact with chemical solvents, such as cleaning liquids that could be applied to the utility brush. The brush can be configured and dimensioned to brush surfaces located within difficult to access spaces and crevices, including small and/or narrow spaces and crevices.

This brief description of the invention is intended only to provide an overview of subject matter disclosed herein according to one or more illustrative embodiments, and does not serve as a guide to interpreting the claims or to define or limit the scope of the invention, which is defined only by the appended claims.

BRIEF DESCRIPTION OF THE DRAWINGS

So that the manner in which the features of the invention can be understood, a detailed description of the invention to certain embodiments of the invention is provided herein, some of which are illustrated in the accompanying drawings. It is to be noted, however, that the drawings illustrate only certain embodiments of this invention and are therefore not to be considered limiting of the scope of the invention, for the scope of the invention can encompass other effective embodiments.

The drawings are not necessarily to scale. The emphasis of the drawings is generally being placed upon illustrating the features of certain embodiments of the invention. In the drawings, like numerals are used to indicate like parts throughout the various views. Differences between like parts may cause those parts to be indicated with different drawing reference numerals. Unlike parts, if indicated with drawing reference numerals, are to be indicated with different drawing reference numerals. Thus, for further understanding of the invention, reference can be made to the following detailed description, read in connection with the drawings in which:

FIGS. 1A-1H collectively illustrate an embodiment of a handle of an improved utility brush.

FIGS. 2A-2D illustrates a side viewing perspective of an alternative embodiment of the handle having a depth that narrows towards its distal end.

DETAILED DESCRIPTION OF THE INVENTION

Figure 1C:
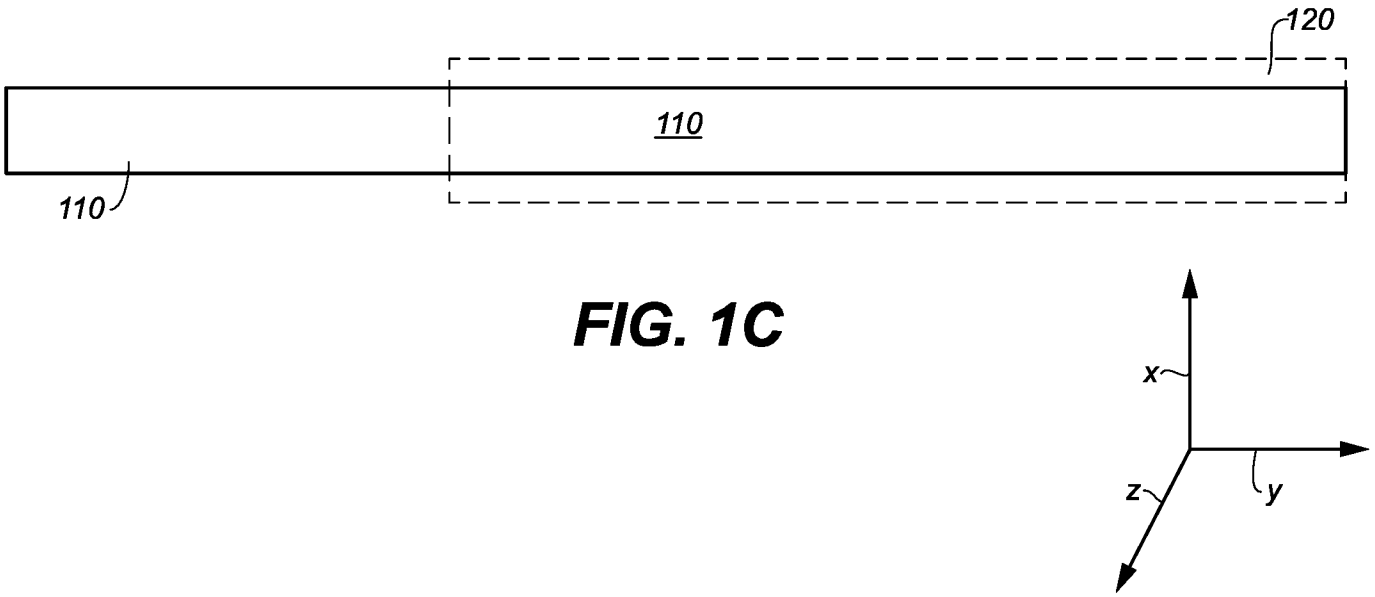

FIGS. 1A-1H collectively illustrate a first embodiment of a handle of an improved utility brush.

FIG. 1A illustrates a top-down viewing perspective of a first embodiment of the handle 110 of a utility brush 130. As shown from this viewing perspective, the handle 110 is shown as if its broadest side is placed upon a top surface of a table. The handle has a length dimension that is measured parallel to a Y axis, as shown here. This length dimension is also referred to herein as a long dimension of the handle, and this length (long) dimension is greater in size than a width dimension of the handle 110, which is measured parallel to an X axis, as shown here, and the length dimension of the handle 110 is also greater in size than a depth dimension of the handle, which is measured parallel to a Z axis, as shown here. The direction of this viewing perspective is substantially parallel to the Z axis.

For this particular embodiment of the handle 110, the length dimension is equal to 15 inches, the width dimension is equal to 0.74 inches, and the depth dimension is equal to 0.30 inches. The broadest side of the handle 110 is bounded by the length dimension and by the width dimension. In other words, for this particular embodiment, the broadest side is 11.1 square inches in area size, being equal to 15 inches×0.74 inches. This particular embodiment of the handle 110 is made from (extruded) polypropylene. Although extruded polypropylene is a solid plastic (polymer) material, this is a material that lacks a sufficient hardness to scratch many types of surfaces, such as for example, other surfaces that are made from a metal.

In other embodiments, the handle 110 can be made of a mixture of polypropylene and another material, such as another type of polymer. In these embodiments, such a mixture is referred to herein as a polypropylene based material. Such a polypropylene based material is also referred to herein as a material that substantially includes polypropylene.

In some other embodiments of the handle 110, as described herein, a polypropylene based material is a material that is limited to include at least 30 percent polypropylene by volume and/or 30 percent polypropylene by weight. In other embodiments, a polypropylene based material is a material that is limited to include at least 50 percent polypropylene by volume and/or 50 percent polypropylene by weight. In other embodiments, a polypropylene based material is a material that is limited to include at least 70 percent polypropylene by volume and/or 70 percent polypropylene by weight. In yet other embodiments, a polypropylene based material is a material that is limited to include at least 90 percent polypropylene by volume and/or 90 percent polypropylene by weight.

FIG. 1B illustrates a top-down viewing perspective of an embodiment of a bristle sleeve 120, also referred to as a sleeve 120, that functions as a portion (component) of a utility brush. As shown here, this bristle sleeve is shown while it is un-attached to other portions of a utility brush.

As shown from this viewing perspective, the bristle sleeve 120 is shown as being oriented as if one of two broadest side of the sleeve 120, is placed upon a top surface of a table. For the purpose of this discussion, a bristle side (surface) of the bristle sleeve, as opposed to a bare side (surface) of the bristle sleeve, faces a viewer from this viewing perspective of this FIG. 1B. The term "bare side" meaning a side (surface) that is absent of bristles. The sleeve 120 has a length dimension that is measured parallel to a Y axis, as shown here. This length dimension, as measured parallel to the Y axis, is also referred to herein as a long dimension of the sleeve 120, and this length (long) dimension is greater in size than a width dimension of the sleeve 120, which is measured parallel to an X axis, as shown here. The width dimension of the sleeve 120, which is measured parallel to the X axis, is also greater than a depth dimension of the sleeve, which is measured parallel to a Z axis, as shown here.

The bare side (surface) of this bristle sleeve 120 is designed to surround and make physical contact with and attach to at least a distal end of the handle 110. This sleeve has a structure that is similar to that of a carpet, where it includes a matrix (pile) of protrusions (bristles) that are attached to and protrude away from one side (surface) of a planar shaped backing layer of the bristle sleeve 120, and which is also referred to herein as a bristle side of the bristle sleeve 120 or sleeve 120, and which is one of two broad sides of the bristle sleeve 120, where the bristle sleeve 120 includes (incorporates) a planar shaped backing layer 122, as shown in FIG. 1D.

FIG. 1C illustrates a top-down viewing perspective of the bristle sleeve 120 as it is attached to a distal portion, being a right hand side portion, of the handle 110, as shown from the viewing perspective of FIG. 1A. As shown here, a perimeter of the bristle sleeve 120 is represented by a dashed line. This dashed line marks an extent of where the bristles of the sleeve 120 protrude away from the backing of the sleeve 120. Theses bristles are not shown here, and are instead shown in FIG. 1D.

Preferably, the bristle sleeve 120 is wrapped in a direction along a wrapping pathway that encircles the long dimension of the handle 110, and surrounds a portion of the length (long) dimension of the handle 110. Said another way, this wrapping pathway surrounds the long dimension of the handle 110 and is directed substantially parallel to the X and/or the Z axes, and substantially perpendicular to the Y axis. A proximal end, being a left hand side of the handle 110, as shown from this viewing perspective, remains unobstructed from the wrapping of the bristle sleeve 120 surrounding the handle 110. In other embodiments, the bristle sleeve 120 is configured to surround a larger or smaller portion of the handle, and in some embodiments, to surround an entirety of the length of the handle 110.

FIG. 1D illustrates a side viewing perspective of the bristle sleeve 120. Like shown in FIG. 1B, this bristle sleeve 120 is shown while it is un-attached to another portions of a utility brush. Also like shown in FIG. 1B, the longer dimensions of the sleeve 120 are oriented horizontally as if it was placed lying onto a top surface of a table, which is horizontal relative to the surface of the earth. No table is shown here.

However, unlike what is shown in FIG. 1B, the viewing perspective here is instead a side viewing perspective that is directed substantially parallel to the X axis, which is parallel to a top surface of a table upon which the sleeve 120 is lying, and not a top-down viewing perspective of FIG. 1B, that is substantially parallel to the Z axis and perpendicular to a top surface of a table.

As shown, the bristle sleeve includes a backing layer 122. The backing layer 122 has an exterior (bristle) surface (side) that is attached to a matrix (pile) of bristles 124, and the backing layer 122 also has an opposite interior (bare) surface (side) that is not attached to bristles. As will be described, the interior (bare) surface (side) of the backing layer 122 is configured to be attachable to the handle 110 via ultrasonic welding. From this viewing perspective, the exterior bristle surface (side) of the backing layer 122 is facing upwards, while the interior (bare) surface (side) of the backing layer is facing downwards.

This orientation can occur, when the interior (bare) surface (side) of the backing layer 122 faces and abuts a top surface of a table, for example, and the viewing perspective is directed parallel to and along a top surface of the table, for example. As shown here, the bristles 124 are attached to the backing layer 122 of the sleeve 120 along the exterior bristle surface (side) of the backing layer 122, and where the bristle side is facing upwards, as shown here. The bristles 124 are protruding in an upward direction and away from the bristle (exterior) surface (side) of the backing layer 122, as shown from this viewing perspective.

In this embodiment, the backing layer 122 of the sleeve 120 is made from a non-woven fabric that is made from polypropylene based material. Preferably, this backing layer 122 is made from a polypropylene based material that is entirely polypropylene. However, other embodiments of the backing layer can be made partially of polypropylene. In this type of non-woven fabric embodiment, this material is made from polypropylene fibers that are bonded together to form a layer of polypropylene based material that is typically planar in shape, and that is typically more flexible than same a polypropylene based material that is instead extruded, and of the same dimensions and/or of the same weight. This non-woven material is also referred to herein as a non-woven polypropylene fabric, or as a non-woven polypropylene based fabric.

In other embodiments, the backing layer 122 can be made of a mixture of polypropylene and one or more other materials, including other types of polymers. In these embodiments, such a mixture is also referred to herein as a polypropylene based material. Such a polypropylene based material is also referred to herein as a material that substantially includes polypropylene.

In some other embodiments of the backing layer 122, as described herein, a polypropylene based material is a material that is limited to include at least 30 percent polypropylene by volume and/or 30 percent polypropylene by weight.

In other embodiments, a polypropylene based material is a material that is limited to include at least 50 percent polypropylene by volume and/or 50 percent polypropylene by weight. In other embodiments, a polypropylene based material is a material that is limited to include at least 70 percent polypropylene by volume and/or 70 percent polypropylene by weight. In yet other embodiments, a polypropylene based material is a material that is limited to include at least 90 percent polypropylene by volume and/or 90 percent polypropylene by weight.

Optionally, this non-woven polypropylene fabric can be further, extrusion coated on at least one of its broad sides, with a layer of extruded polypropylene based material. When extrusion coated, this non-woven fabric is referred to herein as a "non-woven polypropylene film", or as a "non-woven polypropylene based film", where the "film" portion of this name identifies the non-woven fabric as having an additional extrusion coated exterior layer, and where such an additional extrusion coated exterior layer causes the non-woven polypropylene based fabric to appear as a film, when viewing this non-woven polypropylene based fabric from a viewing perspective of its extrusion coated exterior side or surface.

If and when incorporated into the bristle sleeve 120, this extrusion coated side of polypropylene based material, preferably functions as a bristle side (surface) of this backing layer 122 of the bristle sleeve 120, because such a film like extrusion coated side (surface) can typically better accommodate ultrasonic welding of bristles than a typical side of a non-woven fabric that lacks such an extrusion coated side.

Preferably, and in some embodiments, this backing layer is a material that is supplied by Arlin Manufacturing of Lowell, Massachusetts. This material is named (identified) by this supplier as a "non-woven polypropylene film". A non-woven polypropylene film being a non-woven polypropylene fabric that is extrusion coated with a layer of polypropylene on at least one broad side of this non-woven polypropylene fabric, to form backing layer 122, as described above.

Note that this particular Arlin Manufacturing supplied material is understood to be made in its entirety or nearly in its entirety from polypropylene. Regardless of what exact amount of polypropylene is within this material, this material is understood to include far more polypropylene than 30 percent by weight and/or by volume, and is consequently, understood herein to fall well within the scope of a polypropylene based material, as defined herein.

This type of polypropylene (based) fabric is characterized as being a non-woven fabric (material) because the polypropylene (based) fibers are not woven together, but instead are bonded together in some fashion, such as compressed together via application of heat and pressure, for example, to form a layer (sheet) of polypropylene based material. This layer (sheet) of polypropylene based material, may or may not be non-porous to the passage of air and/or water.

Preferably, this non-woven polypropylene fabric is non-porous to air and water, either by itself, or via having at least one extrusion coated layer. However, the invention does not require that such fabric be non-porous to air and/or water. In some embodiments, the backing layer 122 may be constructed from multiple layers of material, including a layer of the polypropylene fabric, whether such fabric is woven or non-woven, and whether or not such material is coated with extruded material, provided that bristles 124 can be attached to such a backing material 122, and provide that such a backing material 122 can be attached to a handle 110, using some sort of directed energy type of bonding, such as for example, using heat or ultrasonic welding.

This particular embodiment of the backing layer 122 of the sleeve 120 has a length dimension equal to 10 inches, a width dimension is equal to 2.1 inches, and a depth dimension is preferably equal to 15/1000 inches, which correspond to the Y, X and Z axes respectively. However, in other embodiments, the backing layer 122 can be employed having a depth dimension that falls within a range between 10-20/1000 inches, for example, providing that the backing layer 122 can be wrapped around and attached to a handle 110, and preferably without gaps forming between the handle 110 and the backing layer 122, that are visible to the human eye.

For this embodiment, the bristles that protrude away from the backing layer, are each approximately (about) 200/1000 inches in length. In some embodiments, the sleeve is manufactured as a roll of material having a width dimension equal to 1.75 inches, and a length dimension that can be customized and cut to a length that is much longer than its width dimension. For this embodiment, there are 40 bristles per inch that are uniformly spaced across the width of the sleeve, and 320 bristles that are spaced per inch along a length of the sleeve material. This yields about 12800 bristles per square inch. In other embodiments, the density of bristles along the length of the sleeve material is increased to as much as 640 bristles per inch, yielding 25,600 bristles per square inch. Likewise, the density of bristles along the width of the sleeve material can be varied, if so desired.

FIG. 1E illustrates a top-down viewing perspective of the handle 110 and sleeve 120 as the sleeve 120 is wrapped around and attached to the handle 110. Like shown in FIG. 1C, this top-down viewing perspective is directed parallel to the Z axis. As shown, the bristle sleeve 120 is wrapped around a perimeter of the handle 110 and around the Y axis dimension of the handle 110, and wrapped in a wrapping direction that is substantially parallel to a plane defined by the X and Z axes. A left hand side of the handle 110 remains un-obstructed from the wrapping of the sleeve 120 around the handle 110. This figure shows bristles 124 protruding away from the bristle sleeve 120 while the bristle sleeve 120 is attached to the handle 110.

Alternatively, and in some embodiments, prior to attaching the bristle sleeve 120 to the handle 110, a first long edge of the bristle sleeve 120 is bowed (curved) over and attached to a second (opposite) long edge of the bristle sleeve 120, to form the bristle sleeve 120 into a shape of a hollow and cylindrical shaped tube, where the bristles of the bristle sleeve 120 project away from an outside (exterior) surface (side) of this hollow and cylindrical (tube) shaped bristle sleeve 120. An inner (interior and bare) surface of this hollow tube shaped bristle sleeve is oriented to physically surround, and make physical contact with, and slide over an end of the long dimension of a handle, that can itself be tube shaped, or stretched around to hug a bar shaped handle, like that shown in FIG. 1A.

Preferably, the polypropylene based fabric that is referred to above, is sufficiently flexible so that it can be either wrapped around an outside surface of the handle 110, and preferably without gaps that are visible to the human eye, forming between the fabric and the handle 110. Or alternatively, a hollow tube shaped bristle sleeve 120 can be formed and sized to wrap around a handle 110 that is also shaped as a hollow cylindrical shaped tube.

In some embodiments, the bristle sleeve 120 is sized and shaped so that it can be slid around a cylindrical tube shaped handle via the application of hand strength. Preferably, such hand strength is not required to be more than 5 pounds of force supplied from each of a maximum of two hands. Preferably, other materials employed for the backing layer of the bristle sleeve, also have such sufficient flexibility. But such flexibility, although preferred, is not required to practice the invention described and claimed herein.

Figure 1F:
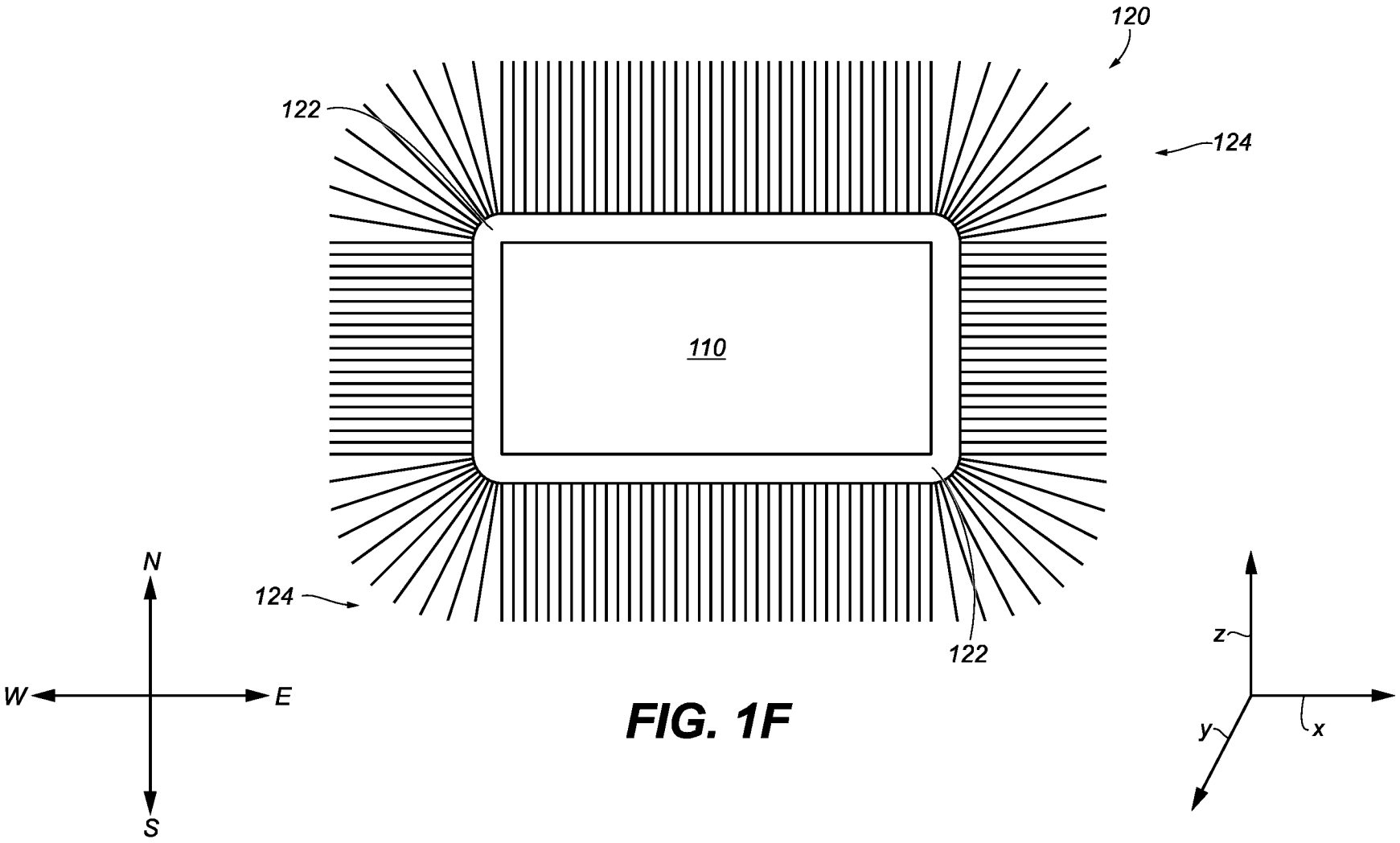

FIG. 1F illustrates an alternative end side perspective view of a distal end of the handle 110 and the sleeve 120 while the sleeve 120 is attached to the handle 110. This alternative end side perspective view is directed parallel to the Y axis, as opposed to the direction of other shown prior side perspective views. As shown and preferably, the backing layer 122 of the sleeve 120 is wrapped tightly around the handle 110, to an extent that there are no voids (air pockets) that are visible to the naked eye. Despite there being no air pockets that are visible to the naked human eye, there may be pockets, if any, that are located in between the exterior surfaces of the handle 110 and the interior (bare) side of the backing layer of the sleeve 120, that are located away from an edge of the bristle sleeve 120, and that are hidden from the human eye, while the interior (bare) side of the sleeve 120 is attached to the handle 110.

After wrapping the bristle sleeve 120 around the handle 110, the sleeve is attached to the handle via ultrasonic welding of the sleeve 120 to the handle. The ultrasonic welding directs energy at a plurality of different locations through the exterior surface (side) of the backing layer 122, through the backing layer 122 and through the interior (bare) surface (side) of the backing layer 122 and through a corresponding location along an exterior surface (side) of the handle 110.

This path of directed energy causes the backing layer 122 at each of the plurality locations along the backing layer 122 to fuse (melt) with a corresponding location along an exterior surface of the handle 110. Each location along the exterior surface of the handle melts (fuses) and later cools to a room temperature. Upon cooling to a room temperature, the location of fusing forms a bond (attachment) between the exterior surface of the handle and the backing layer 122 of the bristle sleeve 120. This technique is somewhat analogous to performing a type of spot welding of the backing layer 122 of the bristle sleeve 120 to the exterior surfaces of the handle 110.

Figure 1G:
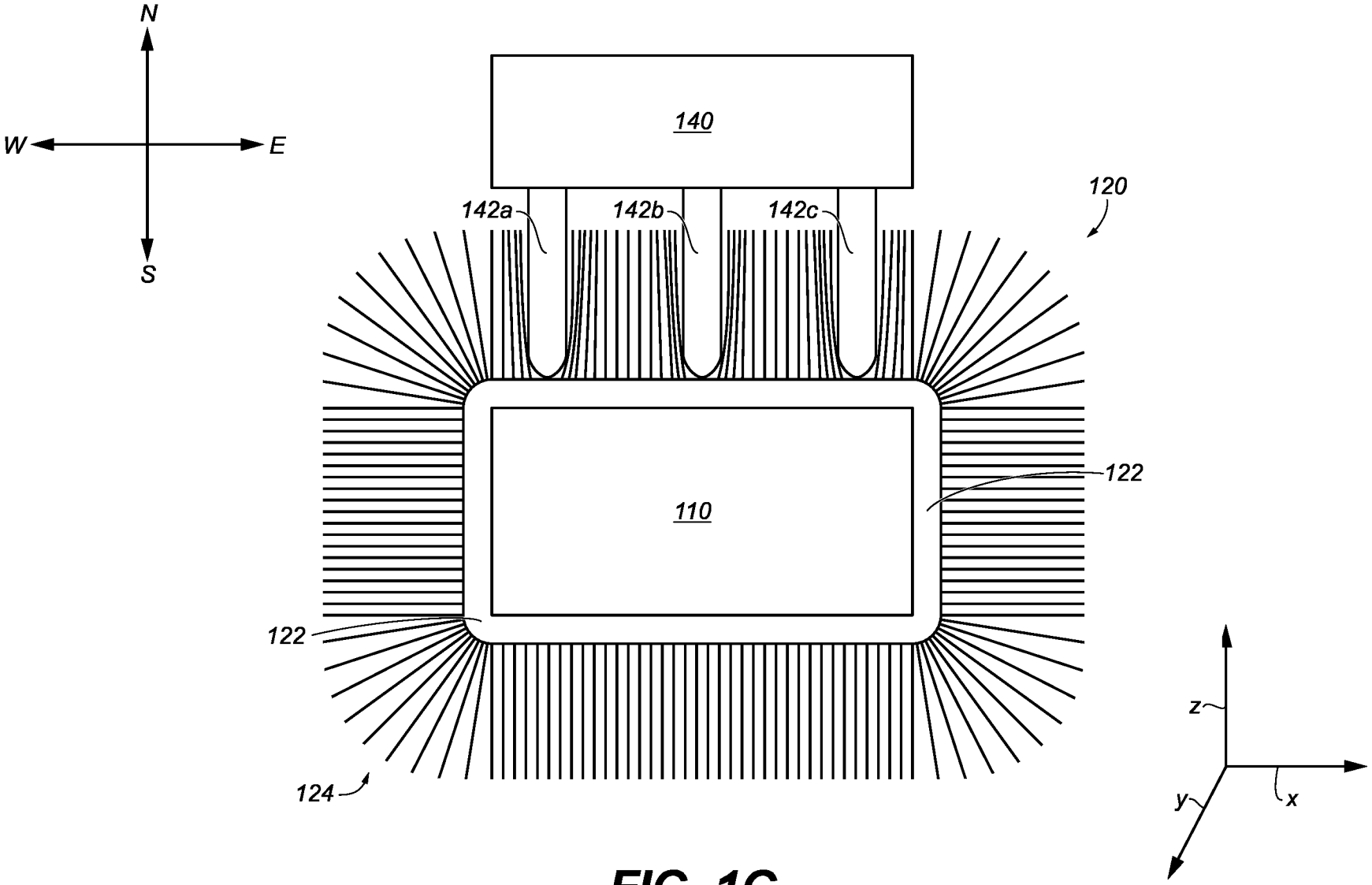

FIG. 1G illustrates an ultrasonic welding device 140 and how its ultrasonic probes (prongs) 142*a*-142*c*, also referred to as probes or prongs, are inserted in between bristles 124 protruding from the bristle sleeve 120, in order to make physical contact with the exterior outside surface (side) of the backing layer 122 of the bristle sleeve 120. These ultrasonic probes 142*a*-142*c* direct ultrasonic energy away from the probe and along a path through the exterior surface (side) and the interior surface (side) of the backing layer 122 of the bristle sleeve 120 and into the handle 110 itself, generating and transferring of energy that manifests in the form of heat along that path and causing bonding (fusing/attaching) between the backing layer 122 of the bristle sleeve 120 and the handle 110. Attaching the backing layer 122 to the handle 110 attaches the bristle sleeve 120 to the handle 110, because the backing layer 122 is incorporated into and attached as a portion of the bristle sleeve 120.

As shown, the ultrasonic probes are applied along the north (N) side (face) of the bristle sleeve 120 and handle 110 combination, proximate to the distal end of the handle 110, while the bristle sleeve 120 is wrapped around the handle 110. Preferably, ultrasonic probes are further applied across the north face of the bristle sleeve 120 and handle 110, between the proximal side, a location farthest away from the distal end of the bristle sleeve 120 and handle 110, to the distal side of the bristle sleeve 120 and handle 110, and applied in the same or similar manner along the east (E), west (W) and south (S) sides of the bristle sleeve 120 and handle 110, while the bristle sleeve 120 is wrapped around the handle 110.

The number, geometric arrangement and location of application of the ultrasonic probes 142*a*-142*c* can vary between embodiments of the invention. In some embodiments, the probes (prongs) are applied at locations or points (spatial intervals) that are one (1) inch apart from each other, along the length dimension (Y axis) of the handle 110 and backing layer 122 of bristle sleeve 120, such that with each application of ultrasonic energy of probes 142*a*-142*c* the locations or points of attachment between the backing layer 122 and handle 110 are grouped at a set spatial relationship with each other in accordance with arrangement of the probes 142*a*-142*c* extending from the structure of ultrasonic welding device 140, such as shown for example in FIG. 1G. However, the number and geometric arrangement of the placement of these probes 142*a*-142*c*, and the location and size of these spatial intervals where the probes are applied, can vary depending upon the goals and objectives associated with a particular design of a utility brush, while employing other aspects of the subject matter of the invention.

Figure 1H:
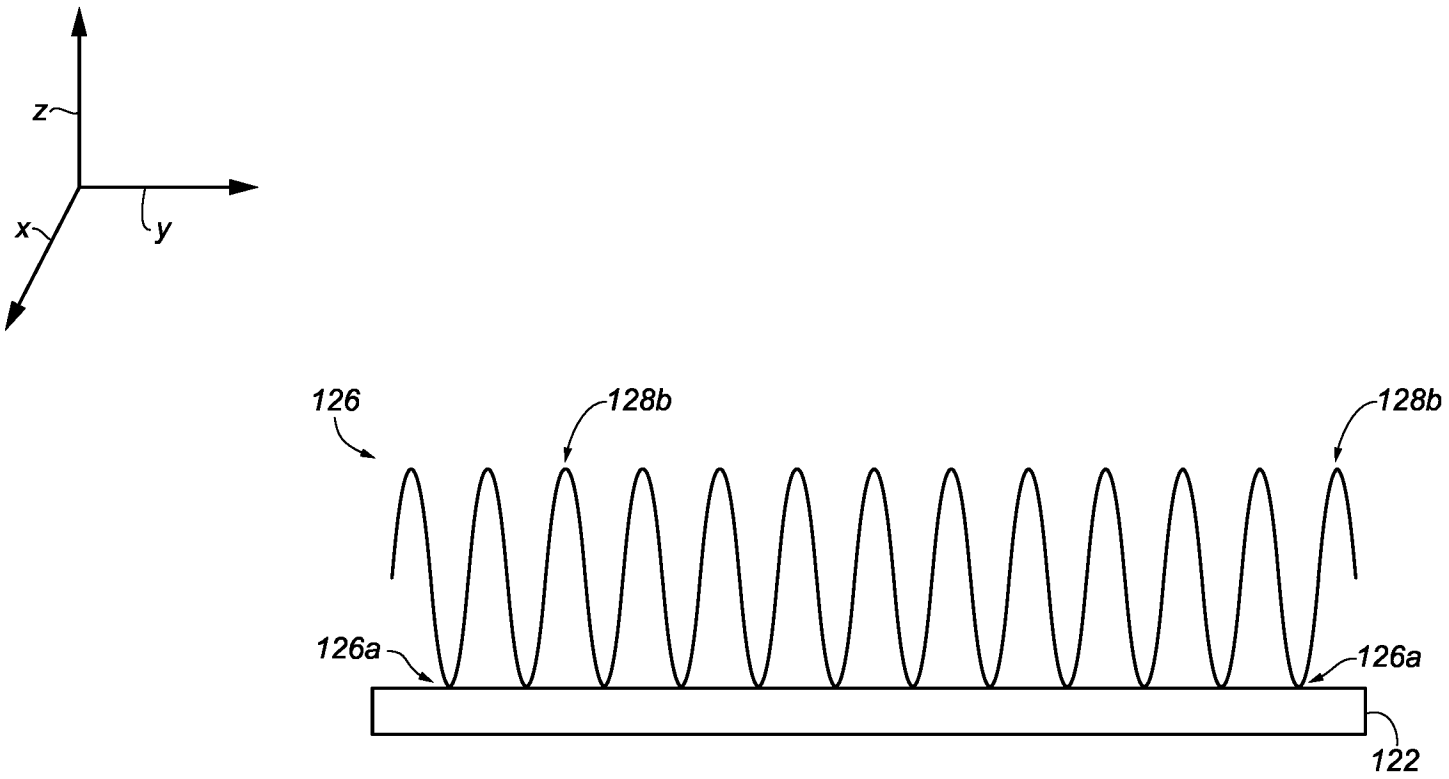

FIG. 1H illustrates a particular method of construction for an embodiment of a bristle sleeve 120. As shown, pre-cut bristle material 126, also referred to herein as raw bristle material 126, or just as bristle material 126, is formed in a shape of a long string, and is further oriented into a cyclic loop pattern where one lower portion of the cyclic loop pattern is placed in physical contact along an upper (exterior) surface (side) of a backing layer 122. Both the bristle material and the backing layer 122 are preferably each made from a polypropylene based material. Where such polypropylene (PP) based material is comprised at least the lesser of, 30 percent polypropylene (PP) by volume, or at least comprised of 30 percent polypropylene (PP) by weight.

The bristle material 126 and the backing layer 122 are bonded together at points of physical contact 126*a* between the bristle material, and the backing layer 122. Such bonding is preferably performed via ultrasonic welding. Ultrasonic welding directs energy towards and through each point of contact 126*a*, causing the bristle material 126 and the backing layer 122 to at least partially melt and fuse together at and proximate to the point of contact 126*a*, and upon subsequent cooling, to bond together at each of these points of contact 126*a*. Such welding requires both the backing layer 122 and the bristle material to each be made from a material including polypropylene.

After such bonding occurs, locations along the upper portions of the cyclic loop pattern of the bristle material 126, are each severed (cut) at a points 128*b* along each and every loop that protrudes upward and away from the backing layer 122. Preferably, each loop is cut so that the remaining severed segments of each loop are equal or substantially equal in length, as measured between the outer (exterior) surface (side) of a backing layer 122 and the cutting point 128*b* along each loop of the bristle material that is protruding upward and away from the backing layer 122. Because the bristle material does not penetrate the backing layer 122, this embodiment is referred to herein as having non-woven bristles, meaning an embodiment having a non-woven type of bristle attachment to the backing layer 122.

In other embodiments, the pre-cut bristle material, as oriented in a cyclic loop pattern as shown in FIG. 1H, is instead woven through the backing layer 122, so that the lower portions of the cyclic loop pattern of the pre-cut bristle material are each penetrating through the exterior (top surface as shown here) and the interior surface (bottom surface as shown here) of the backing layer 122, and looping in a opposite direction to penetrate back through the interior surface (side) and the exterior surface (side) of the backing layer 122, in a cyclic pattern. For this embodiment, the cyclic loop pattern is optionally also cut in the same manner as described for the non-woven type of embodiment.

In yet other embodiments, the bristle material can be made from other than a polypropylene based material. For example, in some embodiments, the bristle material is made from a nylon based material that is woven into and through a polypropylene based backing layer 122. Or, the bristle sleeve is made from a composite material, being a mixture or blend of polypropylene (PP) and an anhydride modified polypropylene (AMPP), for example, that is aa type of material that is effective to enable ultrasonic weld bonding between polypropylene (PP) and nylon. In some embodiments, this AMPP is material that has been provided under the trade name of Plexar, by Equistar Chemicals of Houston, Texas. Plexar is a material having properties that promotes bonding between polypropylene and nylon. Such material may be acquired via other providers.

A further description of how such material is employed to bond polypropylene together with nylon, can be found within the U.S. Patent Publication No. 2013/0236684 to Loughney et al., also referred to herein as the '684 reference, that was published Sep. 12, 2013 and entitled "Pile Weatherstripping . . . Polypropylene"

Note that within the '684 reference, what is referred to as a "pile", is referring to a plurality of filaments, threads or yarn, as attached to and protruding form a backing layer of weather stripping. Within this '684 reference, the backing layer of such weather stripping is referred to as a "backing".

In some embodiments of the invention, the techniques that are described within the '684 reference for attaching a pile of filaments, threads or yarn to a backing within embodiments weather stripping, can also be and are employed to attach bristles to a backing layer of a bristle sleeve 120, incorporated into a utility brush, in accordance with this invention.

Likewise, a further description how to bond a pile of filaments or yarn to a backing layer of weather stripping, is described within U.S. Patent Publication No. 2019/0078379 to Loughney et al., also referred to herein as the '379 reference, that was published Mar. 14, 2019 and entitled "Article of Weather Stripping". This reference expands upon how to create weather stripping, in the form of a dust plug, having filaments of higher spatial density and/or having a backing layer that made from a non-woven polypropylene film (NWPPF), being a non-woven polypropylene fabric that is extrusion coated with polypropylene on one side. Such a backing that is made from NWPPF is typically more flexible than that of traditional weather stripping.

In some embodiments of the invention, the techniques that are described within the '379 reference for attaching a pile of filaments, threads or yarn to a backing within embodiments weather stripping, can also be and are employed to attach bristles to a backing layer 122 of a bristle sleeve 120, within some embodiments of the utility brush.

Figure 2A:
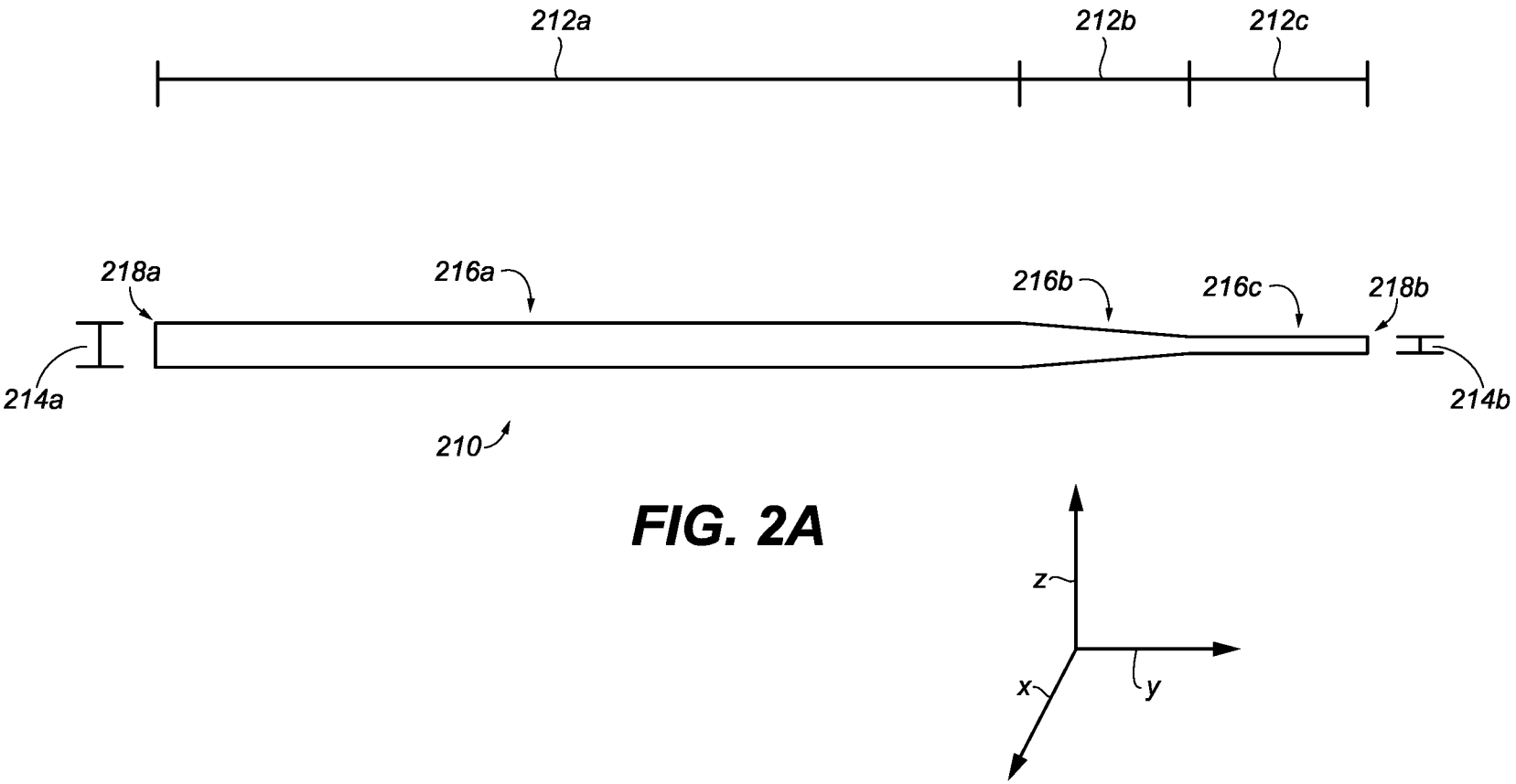

FIG. 2A illustrates a side viewing perspective of an alternative and partially tapered embodiment of the handle 210 having a depth dimension, that varies and that narrows from its proximal end to its distal end. From the viewing perspective shown here, the proximal end 218*a* of the handle 210 being shown here as the left hand side of the handle 210, and the distal end 218*b* of the handle 210 being shown here as the right hand side of the handle 210. This design is different from the handle 110 of FIGS. 1A-1G with respect to the depth dimension of the handle 110. For FIGS. 1A-1G, the depth dimension of the handle 110 does not vary and is instead fixed and uniform between the distal end 218*b* and the proximal end 218*a* of the handle 110.

As shown, for this embodiment, the handle 210 has a maximum and uniform depth dimension 214*a* equal to 0.30 inches along its proximal portion 216*a*, and which is located starting at its proximal (left hand side) end 218*a* of the handle 210. As shown here, the length 212*a* of the proximal portion 216*a* of the handle 210 being measured parallel to the Y axis, and being equal to 10.5 inches. This proximal portion 216*a* of the handle 210 has a uniform (fixed) depth 214*a* equal to 0.3 inches, as measured parallel to the Z axis, as shown here.

A central portion 216*b* of the handle 210, has a length 212*b* that extends 2.5 inches in the rightward direction away from a right hand side of the proximal portion 216*a* of the handle 210. This central portion 216*b* has a non-uniform depth that reduces (narrows) from a depth equal to 0.30 inches on its most proximal (leftward) side to a depth equal to 0.05 inches on its most distal (rightward) side, the depth 216*b* being measured parallel to the Z axis, as shown here. For this embodiment, the rate of narrowing of this non-uniform depth of the central portion 216*b* is a constant value. This constant value is a 0.25 inch depth dimension reduction (narrowing) across a length dimension of the central portion 216*b* equal to 2.5 inches, equaling 0.1 inch depth reduction, as measured parallel to the Z axis, per inch of rightward distance into and along the long dimension of the central portion 216*b* of the handle 110, as measured parallel to the Y axis.

A distal portion 216*c* of the handle 210 extends in the rightward direction away from the central portion 216*b* of the handle 210. This distal portion 216*c* of the handle 210 has a uniform (fixed) depth 214*c* equal to 0.05 inches and a length dimension 212*c* that extends 2.0 inches rightward from the right side of the central portion 216*b* of the handle 210, and towards the extreme distal (right hand side) end 218*b* of the handle 210, as shown here. In some embodiments, the handle 210 is made from employment of three-dimensional (3D) printing process.

FIG. 2B illustrates a top-down viewing perspective of an embodiment of a bristle sleeve 220 prior to being attached to the handle 210. This viewing perspective is the same as that of FIGS. 1A-1C. Unlike the bristle sleeve 120 of FIG. 1B, this bristle sleeve 220 is not rectangular in shape.

As shown, proximal portion 256*a*, being a left hand side portion, of this bristle sleeve 220 has a length 252*a* equal to 6.5 inches, and a width 254*a* equal to 2.06 inches. A central portion 256*b*, of this bristle sleeve 220, has a length 252*b* equal to 2.5 inches and a width that tapers from 2.06 inches to 1.56 inches, as measured along the X axis, from a proximal (left hand) side to a distal (right hand) side of this central portion 256*b*. A distal portion 256*c*, being a right hand side portion, of this bristle sleeve 220 has a length 252*c* equal to 2.0 inches, and a width 254*b* equal to 1.56 inches.

Figure 2C:
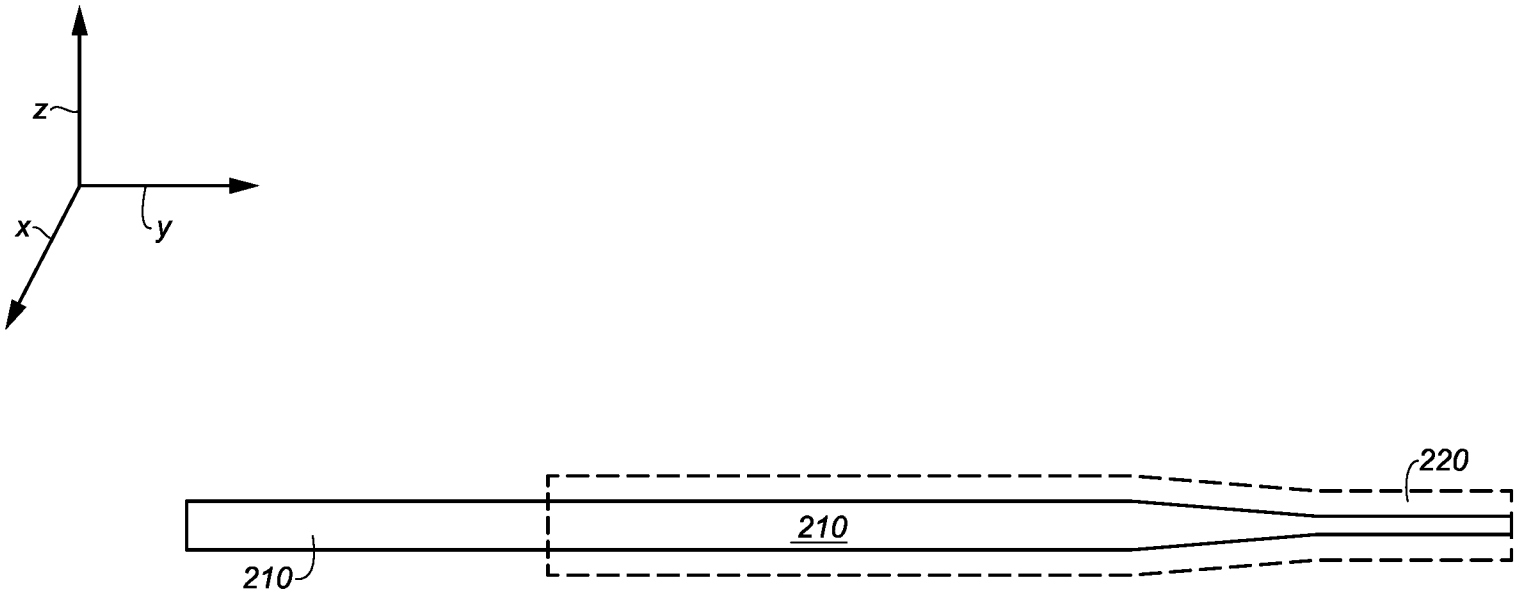

FIG. 2C illustrates a side viewing perspective of a bristle sleeve 220 as it is attached to a distal portion, being a right hand side portion, of the partially tapered embodiment of the handle 210, as shown here. The viewing perspective here, being the same as the viewing perspective of FIGS. 1D-1E. As shown here, a perimeter of the bristle sleeve 220, as it is attached to the handle 210, as shown here, is represented by a dashed line. This dashed line marks an extent of where the bristles of the sleeve 220 protrude away from the backing layer of the sleeve 220. Theses bristles are not explicitly shown here, but bristles like these are better shown in FIGS. 1D-1E.

For this partially tapered embodiment, the backing layer of the sleeve has a length dimension preferably equal to 10 inches, as measured parallel to the Y axis and a depth dimension that is preferably equal to 15/1000 inches. The width dimension, as measured parallel to the X axis, is preferably tailored (dimensioned) so that it can be wrapped completely around and attached to the right hand side portion of the handle 210, without the sleeve 220 overlapping itself while being wrapped around and attached to the handle 220. In other embodiments, the sleeve is at least partially overlapping itself, while wrapped around and attached to the handle 210.

Figure 2D:
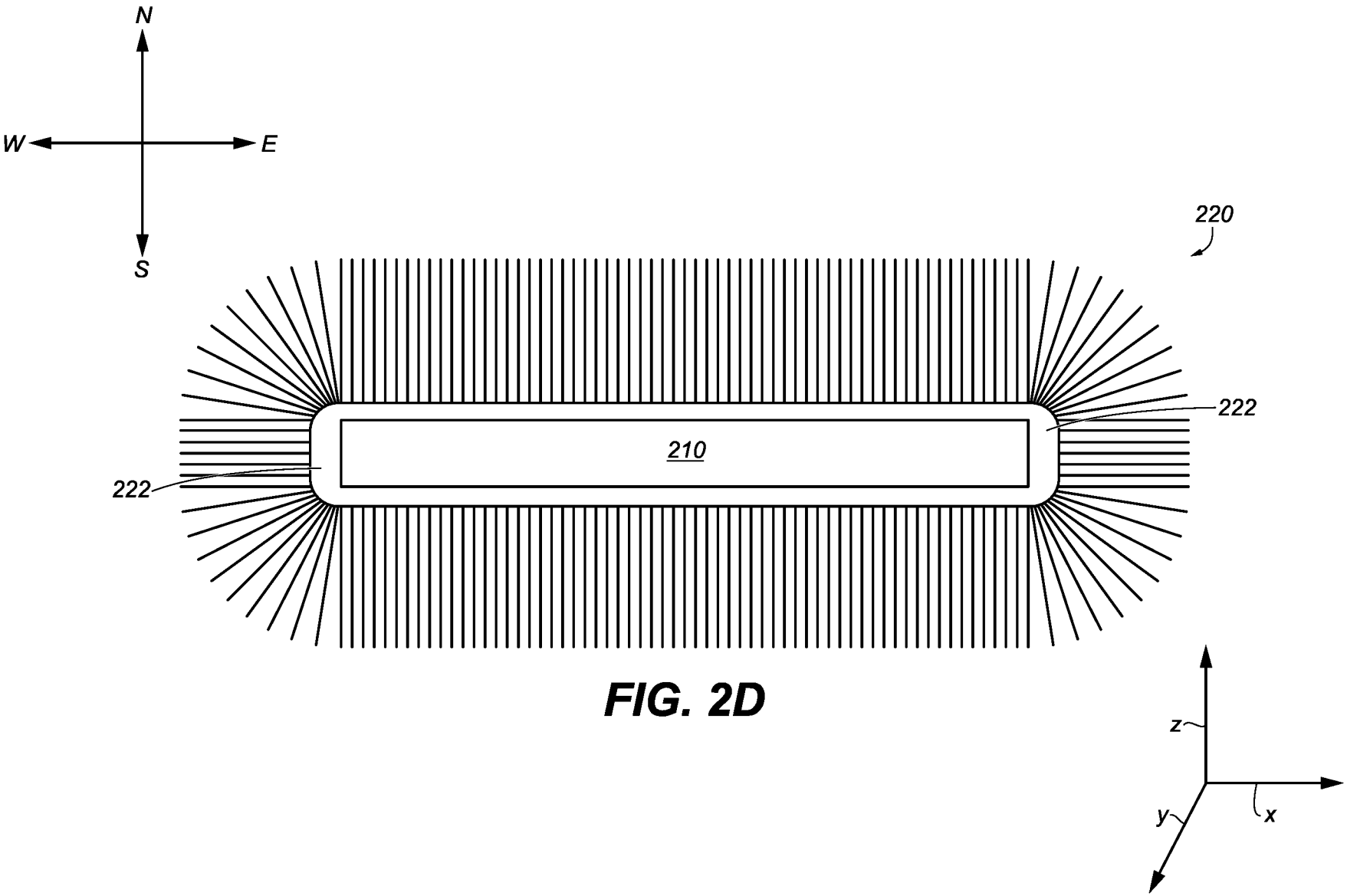

FIG. 2D illustrates an alternative side perspective view of a distal end 218*b* of the partially tapered handle 210 and the bristle sleeve 220 while the bristle sleeve 220 is attached to the handle 210. This alternative side perspective view is directed parallel to the Y axis, and directed from the right hand side to the left hand side of the utility brush, as it is shown in FIG. 1F.

As shown and preferably, the backing layer 222 of the bristle sleeve 220 is wrapped tightly around the handle 210, to an extent that there are no voids (air pockets) that are visible to the naked eye, where air pockets, if any, are located in between the exterior surfaces of the handle 210 and the interior/bare surface (side) of the backing layer of the sleeve 220, while the bristle sleeve 220 is wrapped around and attached to the handle 210. In other words, the backing layer 222 preferably makes maximum physical contact and essentially wraps against and around and hugs the exterior contours of the handle 210, in order to maximize an amount of surface area that is in physical contact with, and an amount of surface area that is potentially attached between the handle 210 and the backing layer 222. The more complex the exterior contours of the handle 210 are, the more difficult and challenging this wrapping step becomes, which places more importance upon the flexibility and upon the accuracy of the tailoring of the dimensions of the backing layer 222, in accordance with the contours of the handle 210.

After wrapping the bristle sleeve 220 around the handle 210, the sleeve is preferably attached to the handle 210 via ultrasonic welding of the sleeve 220 to the handle 210, like that described in association with FIGS. 1F-1G.

This manufactured combination of the handle 210 and the attached bristle sleeve 220 with its protruding bristles, forms a tapered embodiment of a utility brush. Preferably, this tapered embodiment possesses a varying (tapering) depth, as measured along the Z axis, while also possessing a uniform width, as measured parallel to the X axis, and where measured at multiple locations between the proximate and distal ends of the handle 210. In other, embodiments, the width of the handle 210 can be varied, independent of whether depth of the handle 210 is also varied, along the length of the handle 210.

Specifically, for this tapered embodiment, while not factoring the dimensions of the protruding bristles, the width of this distal end of the utility brush shown here, where the handle has a width equal to 0.74 inches and the backing layer 222 has a thickness of 15/1000 of an inch, the overall width of the distal end of this handle 210 is equal to: 0.74 inches+2 (0.015) inches=0.77 inches. The handle 210 at this distal end, where the handle has a depth (height) equal to 50/1000 inches and the backing layer has a thickness equal to 15/1000 inches, without factoring the length of the protruding bristles, has a depth (height as shown here) to be equal to 80/1000 inches.

When factoring the protruding bristles, where the bristles each protrude 200/1000 inches, the width of this distal end is 0.77 inches+0.4 inches=1.17 inches, and the depth (height) is equal to 0.3 inches+2 (0.015) inches+2 (0.2)=0.73 inches. This utility brush enables brushing and/or polishing to be performed in a narrow space, including what is referred to as a crevice.

Figure 3:
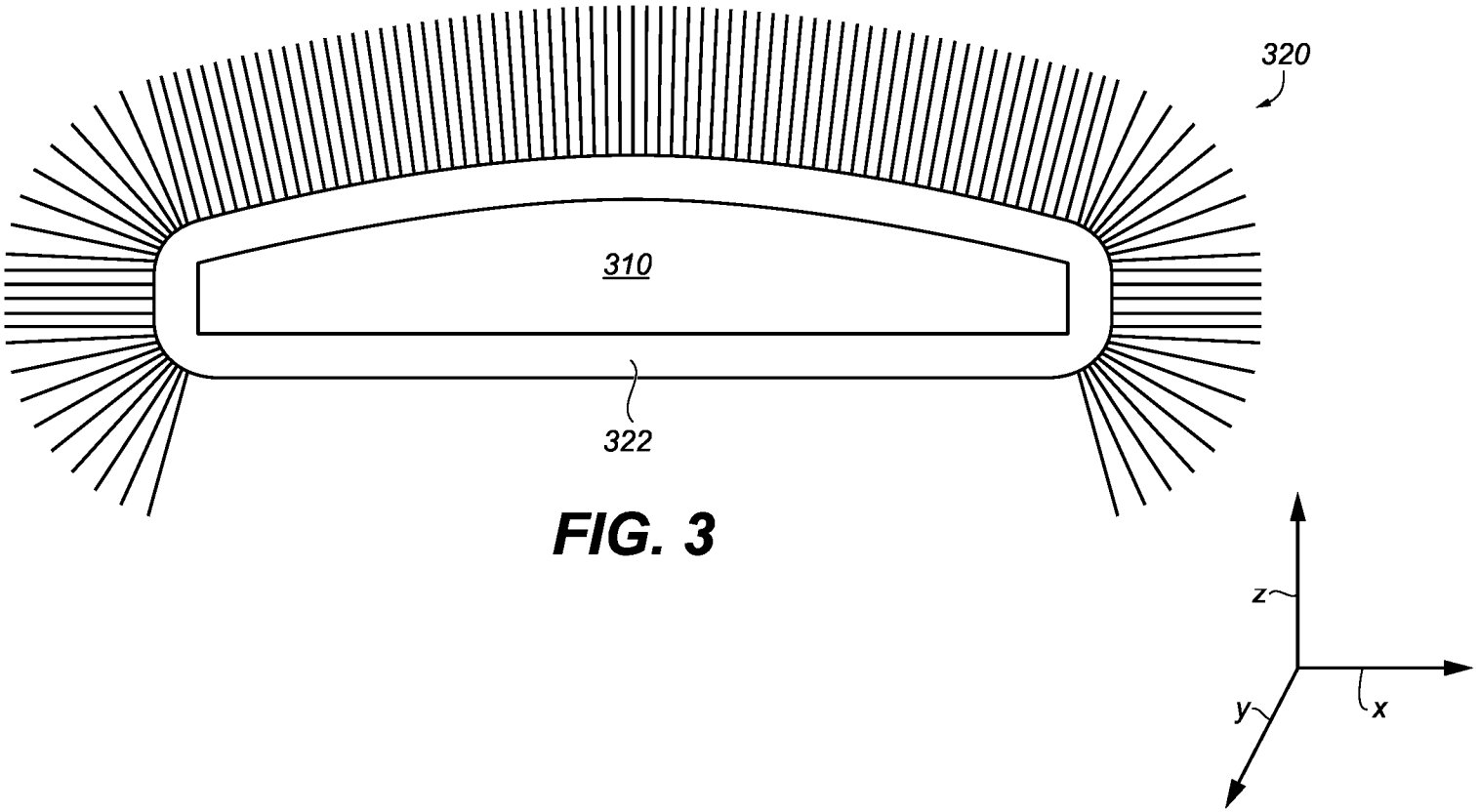
FIG. 3 illustrates an alternative side perspective view of a distal end of a handle and a bristle sleeve while the bristle sleeve is attached to the handle.

FIG. 3 illustrates an alternative side perspective view of a distal end of a handle 310 and a bristle sleeve 320 while the sleeve 320 is attached to the handle 310. This alternative side perspective view is directed parallel to the Y axis, and directed from the right hand side to the left hand side of the handle 310, where the handle 310 is oriented as the handle 110 shown in FIG. 1F.

As shown here, the distal end of handle 310 has a cross-section that does not have a rectangular shape, as that of handle 110 of FIG. 1F and handle 210 of FIG. 2C. An upper surface of this handle 310, as shown via this distal end, is convex curved and bowed upward, while both side surfaces and a lower surface of the handle 310 are flat (straight) and not curved. The side surfaces each abut the lower surface of the handle 310 at a right (90 degree) angle.

This embodiment of the utility brush demonstrates that the handle of this utility brush can be manufactured into a variety of cross-sectional shapes, including curved and/or non-curved surfaces.

Figure 4A:
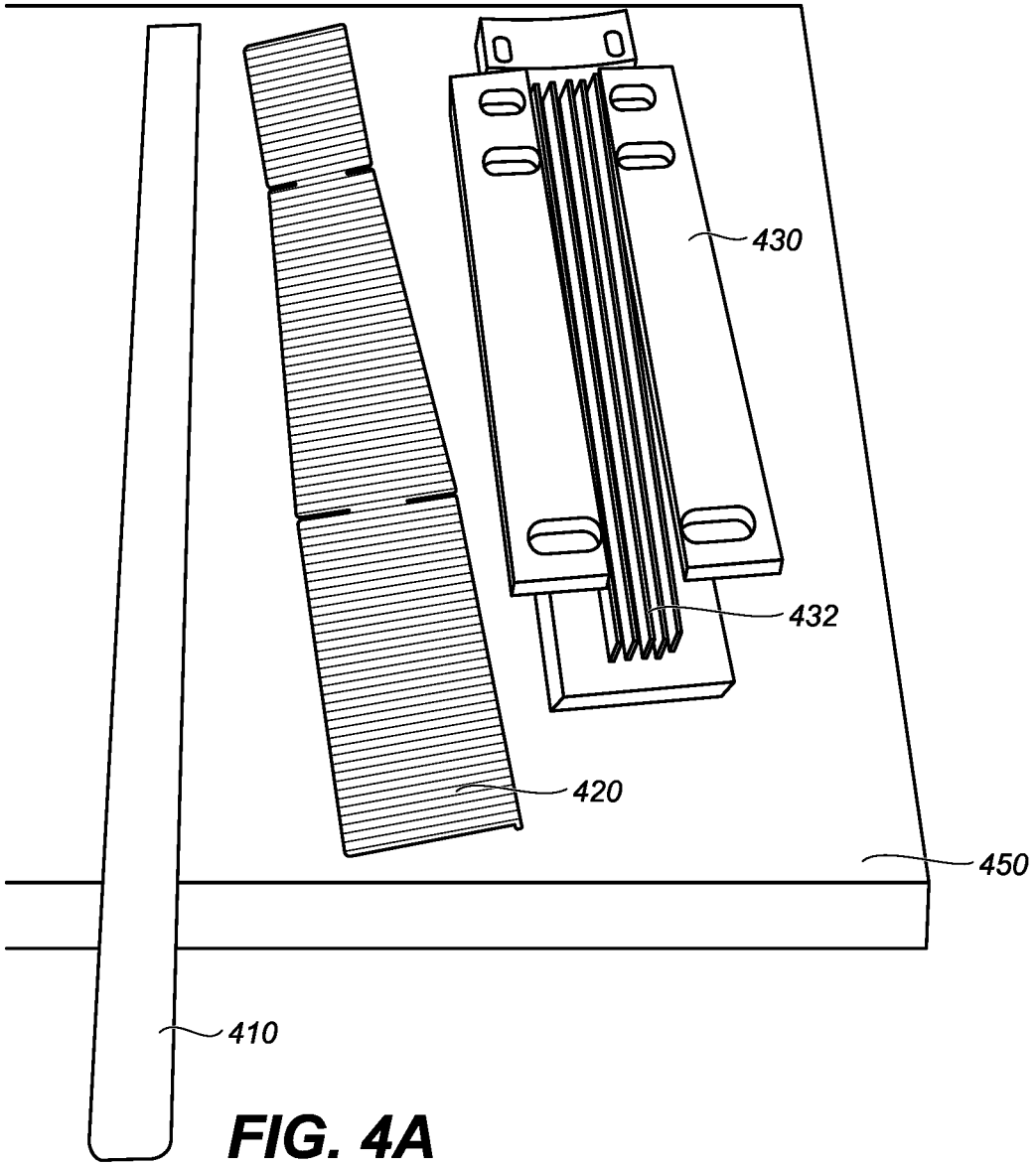
FIGS. 4A-4E are drawings illustrating aspects of the invention.

FIG. 4A is a drawing that illustrates components of an embodiment of a utility brush prior to it being manufactured into one integrated form. As shown, a rectangular shaped handle 410, like that shown FIGS. 1A and 1C, is placed onto a left hand side of an upper surface of a table 450. A bristle sleeve 420 is placed with the exterior/bristle surface (side) facing down and the backing layer (interior/bare) surface (side) facing upwards while it 420 is lying onto the upper surface of the table 450, and placed adjacent and to the right hand side of the handle 410. Notice that the interior/bare surface (side) of the backing layer of the bristle sleeve 420 is shown here as being light in color. Conversely, the opposite (exterior) surface (side) of the bristle sleeve 420, having bristles attached to it and protruding from it, is shown here as being of a dark color.

An embodiment of a tool for facilitating manufacturing of a utility brush, referred to herein as a nest 430, is shown as being placed adjacent to and to the right hand side of the bristle sleeve 420, on the upper surface of a table 450. The nest 430 includes a plurality of (4) metal rails 432. The nest 430 is configured to facilitate ultrasonic welding of the bristled sleeve 420 to the handle 410. The rails 432 are designed to slide in between the bristles of the bristle sleeve 420, and to press directly against the exterior bristle surface (side) of the backing layer, to provide an opposing force against ultrasonic welding probes that press downward and against the bristle sleeve 420 when the bristle sleeve 420 is layered above the handle 410, while ultrasonically welding the bristle sleeve 420 to the handle 410.

Figure 4B:
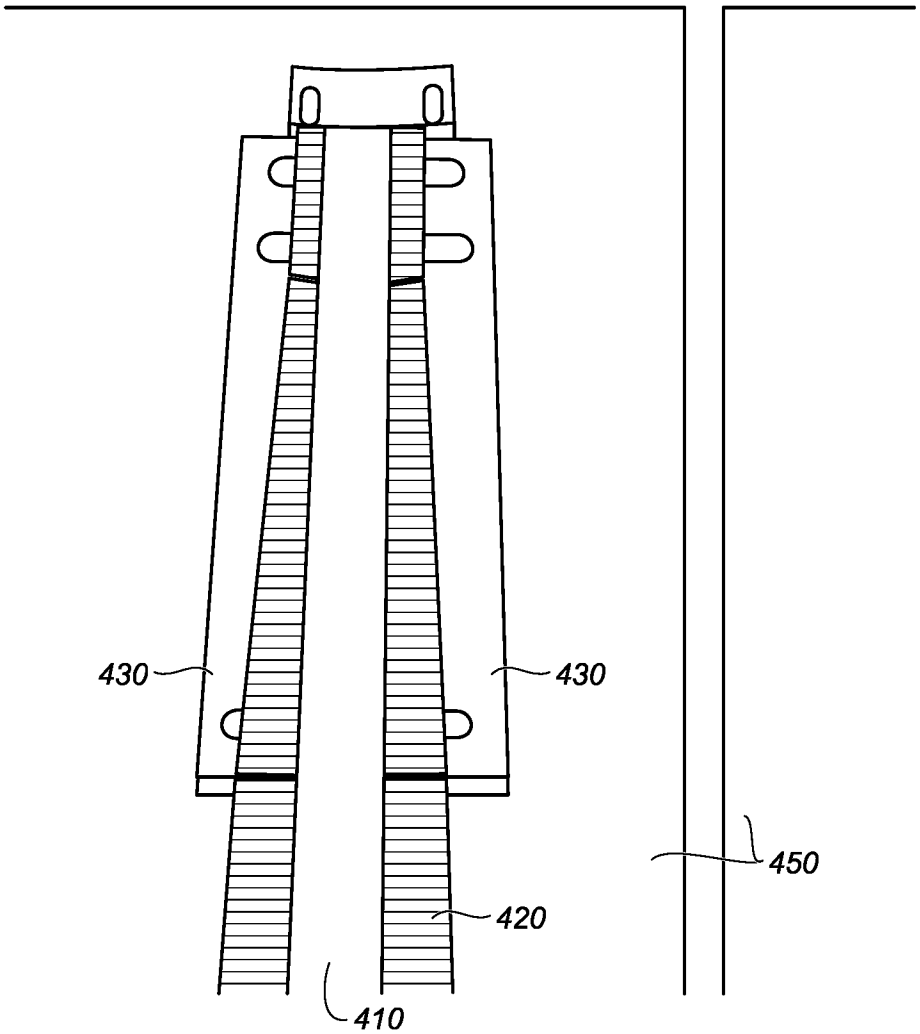

FIG. 4B is a drawing that illustrates the handle 410 being placed on top of the bristle sleeve 420, while the bristle sleeve 420 is placed on top of the rails 432 of the nest 430. This photograph illustrates a step of a method of manufacturing of the utility brush, prior to wrapping the bristle sleeve 420 around the handle 410, and then attaching the bristle sleeve 420 to the handle 410 via a process of ultrasonic welding.

Figure 4C:
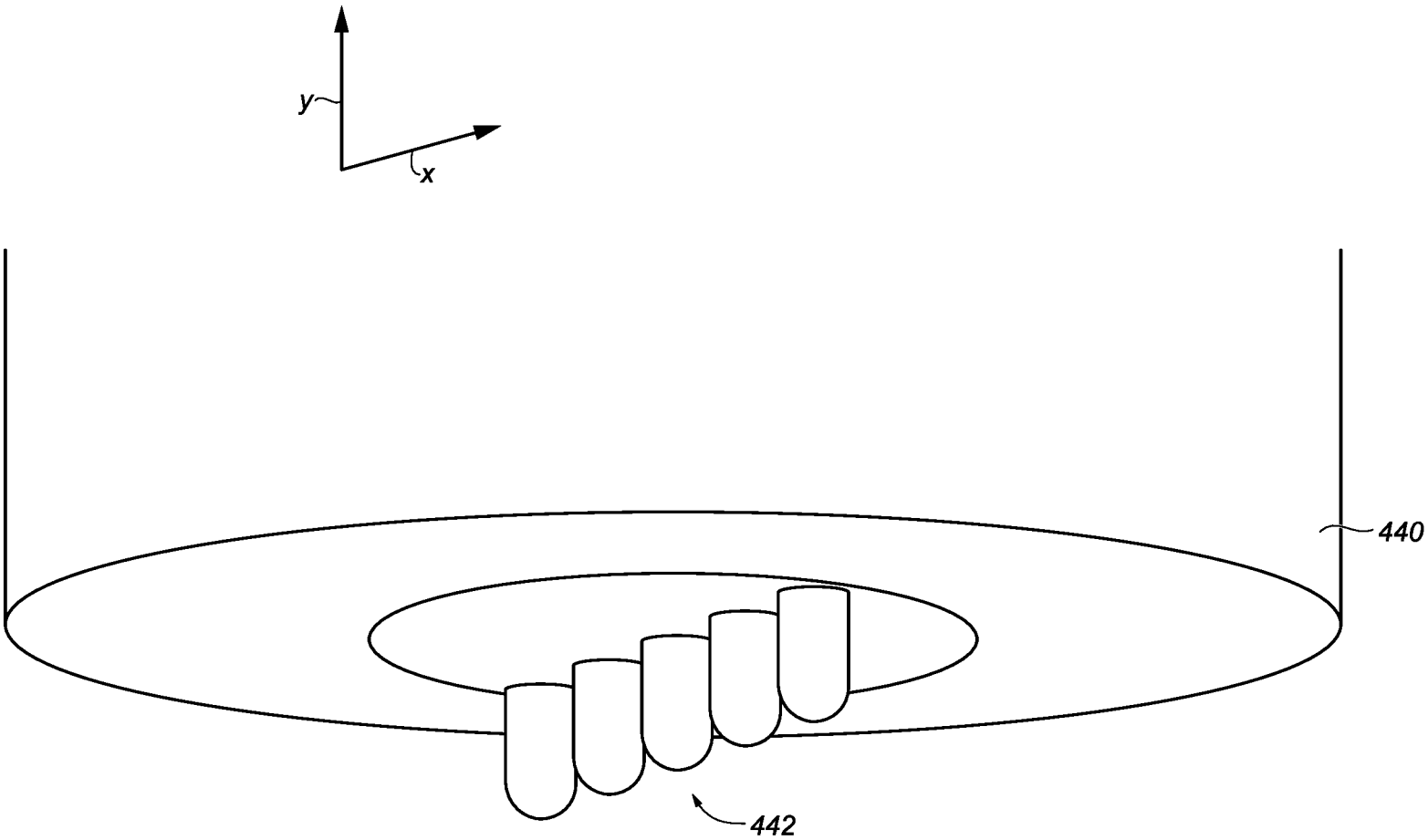

FIG. 4C is a drawing that illustrates a first embodiment of an ultrasonic welding device 440 like that shown in FIG. 1G. As shown, this photograph shows a one dimensional array of five (5) ultrasonic welding probes 442, aligned parallel to an X axis, and which are each configured to direct ultrasonic energy in a downward direction, as shown from this viewing perspective. These probes 442 are dimensioned to be uniform in shape and size.

Figure 4D:
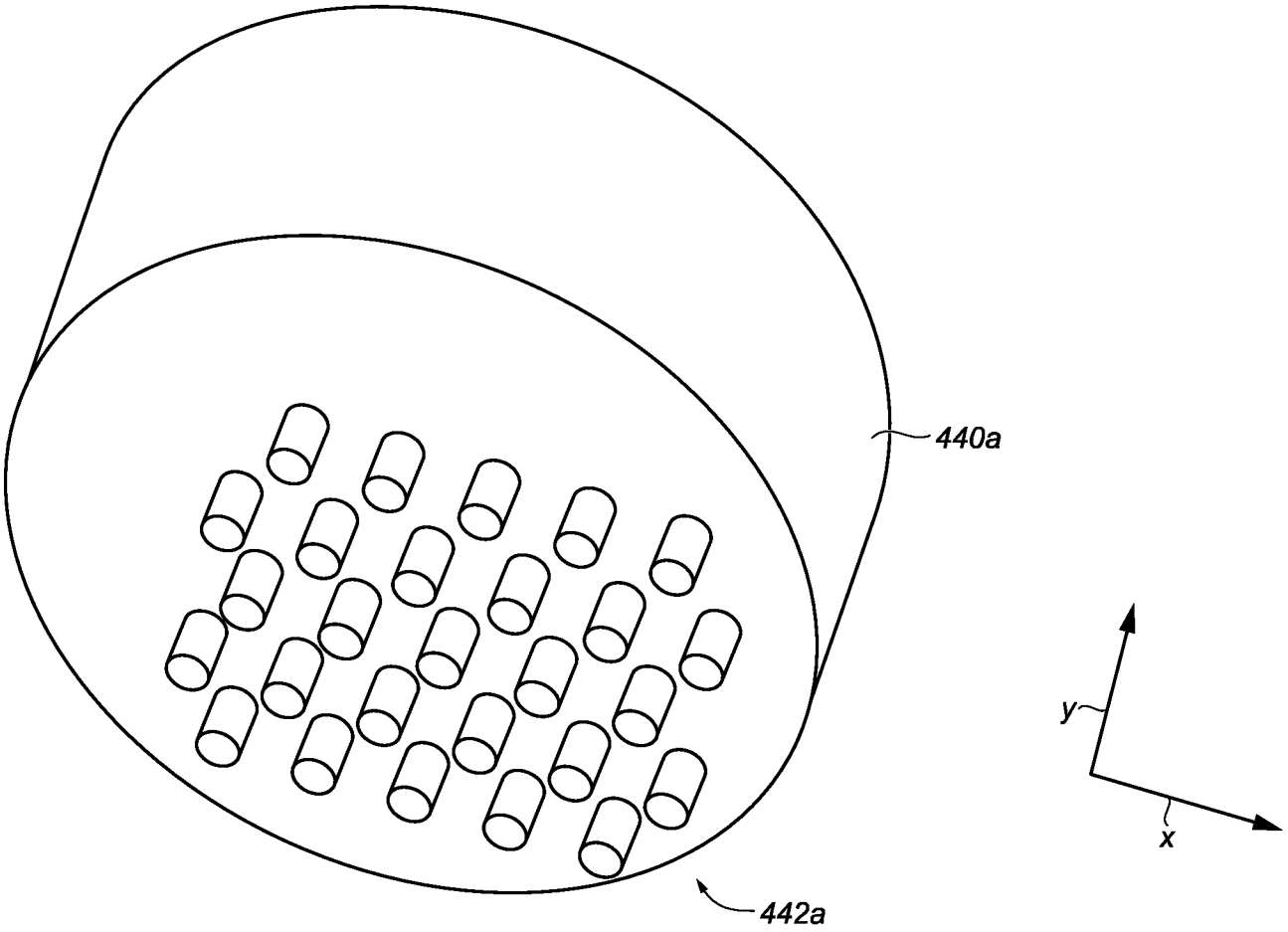

FIG. 4D is a drawing that illustrates a second embodiment of an ultrasonic welding device 440*a*, also like that shown in FIG. 1G. This embodiment of an ultrasonic welding device includes a two-dimensional arrangement (like an array) of ultrasonic welding probes 442*a*. Each of these probes are dimensioned to be uniform in shape and size.

As shown, there are (5) rows of ultrasonic probes, counted in a direction that is substantially parallel to the Y axis, where each row includes either (5) of (6) ultrasonic probes, as counted in a direction that is substantially parallel to the X axis.

Figure 4E:
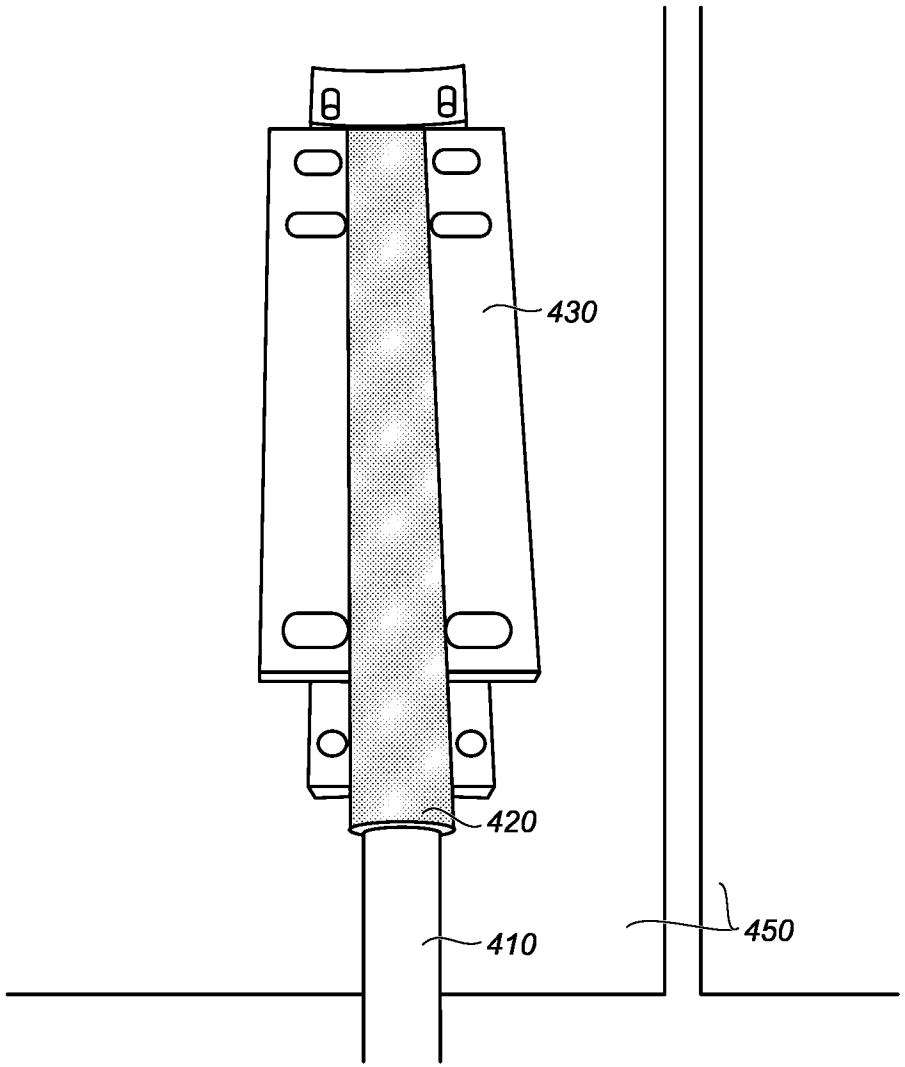

FIG. 4E is a drawing that illustrates a manufactured embodiment of a utility brush like that shown in FIGS. 1A and 1C. This embodiment of the method of manufacturing including the bristle sleeve 420 being wrapped around and ultrasonically welded (attached) to the handle 410.

Figure 5:
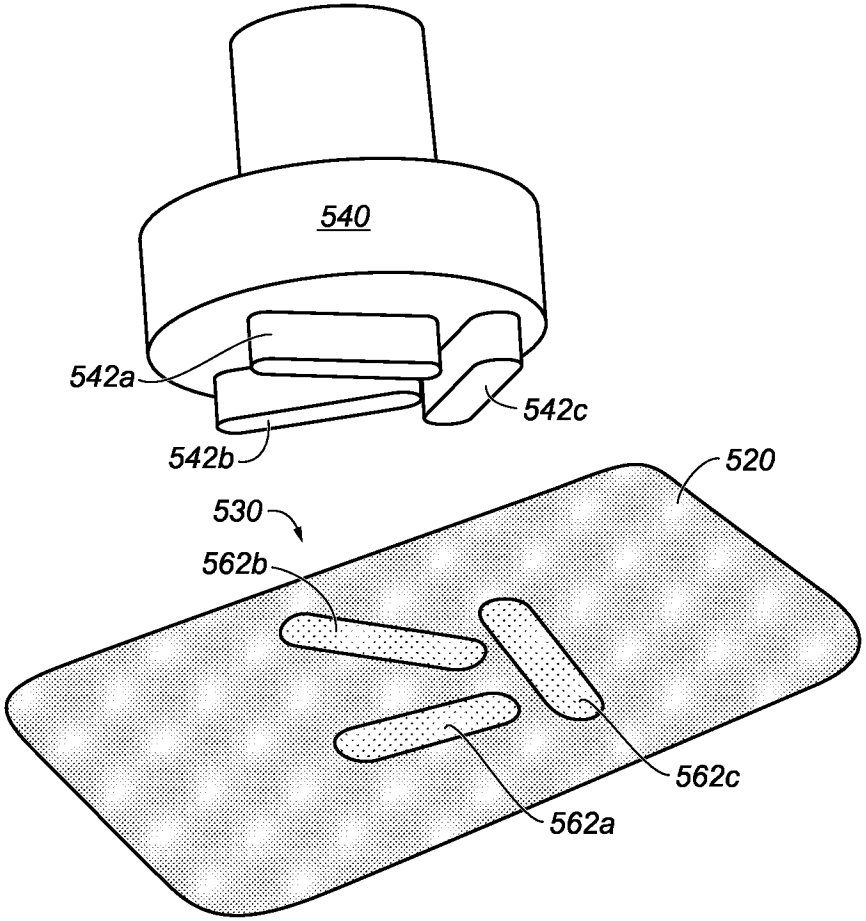
FIG. 5 is a drawing that illustrates an ultrasound welding device 540, also referred to herein as an ultrasound welding head, including a set of ultrasound welding probes that are each shaped and sized and spatially arranged to project ultrasonic welding energy in accordance with a spatial pattern.

FIG. 5 is a drawing that illustrates an ultrasound welding device 540, also referred to herein as an ultrasound welding head 540, including a set of customized ultrasound welding probes 542*a*-542*c*, also referred to herein as ultrasound probes or probes 542*a*-542*c*. The set of customized probes 542*a*-542*c* are each custom shaped and sized (dimensioned) and spatially arranged to project ultrasonic welding energy in accordance with a particular (customized) spatial pattern 530. Each of these probes 542*a*-542*c* is not necessarily required to be uniform in shape and size.

As shown, the spatial pattern 530 is a spatial arrangement of (3) oblong shapes. This spatial pattern 530 can represent information that is associated with an object incorporating a pile of bristles, such as a utility brush, for example, to be marked with such information. Such information can be a trademark, for example, or some other type of indicator of an object for which the spatial pattern is marking.

The ultrasound welding head 540 is preferably applied to direct ultrasound energy to a distal end of each of a set of bristles for marking. Such marking is affected via melting and/or discoloring a distal end of each of this set of bristles. Such marking occurs by placing the distal ends of each of these bristles into physical contact with the probes 542*a*-542*c* during a process of ultrasonic welding.

As a result, the spatial pattern of the probes is, in effect, copied onto the set of bristles residing as a portion of a pile of bristles that are attached to a bristle sleeve 520. The bristle sleeve 520 either being attached to, or to be attached to, a utility brush.

In other words, this spatial pattern of ultrasonic energy can be directed towards material, and as a result, the spatial pattern of ultrasonic energy affects an appearance of that material via an effect of the ultrasonic energy impinging upon that material, causing a marking of the material, where such a marking forms a shape of the spatial pattern on the material, As a result, such an effect manifests itself as a marking upon that material, such an effect (action) is referred to herein as a marking of the material.

Furthering this concept, in some embodiments, probes of the ultrasonic device act as an ultrasonic branding device, that is configured to direct energy for the purpose of marking a surface with a spatial pattern, including a surface of bristles, being a surface formed by endpoints of bristles, that are protruding from a bristle sleeve 120. Unlike the ultrasonic probes shown in FIG. 1G and FIG. 4B, these ultrasonic probes are not necessarily designed to slide in between individual bristles protruding from the bristle sleeve 120, but are instead intended to project ultrasonic welding energy towards the distal ends of the bristles in order to mark the outer (distal) portions of groups of such bristles. Such ultrasonic welding energy being transmitted (projected) from locations proximate to but not necessarily in between the distal ends of such bristles.

The spatial pattern can include a variety of individual geometric patterns and symbols, including alpha-numeric symbols and text, such as required to represent information, such a product identification code, or trademark, just for example.

This written description uses example embodiments to disclose the invention, to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

PARTS LIST

110 handle
120 bristle sleeve for handle 110
122 backing layer
124 bristles
126 pre-cut bristle material
126*a* point of physical contact between bristle material and backing layer
128*b* point of cutting of bristle material
140 ultrasonic welding device
142*a*-142*c* ultrasonic probes/prongs
210 handle of FIG. 2A
212*a* length of the proximal portion 216*a* of the handle 210
212*b* length of central portion 216*b* of the handle 210
212*c* length of distal portion 216*c* of the handle 210
214*a* depth of proximal portion 216*c* of the handle 210
214*b* depth of distal portion 216*c* of the handle 210
216*a* proximal portion of the handle 210
216*b* central portion of the handle 210
216*c* distal portion of the handle 210
218*a* proximal end of the handle 210
218*b* distal (right hand side) end of the handle 210
220 bristle sleeve for handle 210
222 backing layer for bristle sleeve 220
252*a* length of proximal portion of bristle sleeve 220
252*b* length of central portion of bristle sleeve 220
252*c* length of distal portion of bristle sleeve 220
254*a* width of proximal portion of bristle sleeve 220
254*b* width of distal portion of bristle sleeve 220
256*a* proximal portion of bristle sleeve 220
256*b* central portion of bristle sleeve 220
256*c* distal portion of bristle sleeve 220
310 handle of FIG. 3
320 bristle sleeve of FIG. 3
322 backing layer for bristle sleeve 320
410 handle of FIG. 4A

420 bristle sleeve of FIG. 4A with backing (interior/bare) side up

430 nest (tool for facilitating manufacturing of a utility brush)

440 ultrasonic welding device of FIG. 4C

440*a* ultrasonic welding device of FIG. 4D

442 ultrasonic welding probes of FIG. 4C

442*a* ultrasonic welding probes of FIG. 4D

540 ultrasound welding device of FIG. 5

542*a*-542*c* customized ultrasound welding probes

What is claimed is:

1. A utility brush, including:

a handle being made from a material including polypropylene;

a bristle sleeve including a backing layer and pile of bristles, said backing layer being made from a material including polypropylene and having an interior and an exterior surface, and wherein said interior surface of said backing layer being configured to be attachable to said handle; and wherein said exterior surface of said backing layer being attached to said pile of bristles;

said bristle sleeve being configured to be wrapped around said handle so that said interior surface of said bristle sleeve is in physical contact with an outer surface of said handle; and wherein said backing layer of said bristle sleeve being attached to said outer surface of said handle at a plurality of points, spatially separated from each other, along said handle and said backing layer, wherein one or more groups of different ones of said plurality of points are at a set spatial relationship with each other.

2. The utility brush of claim 1, wherein said backing layer of said bristle sleeve is attached to said outer surface of said handle at each of said plurality of points by ultrasonic welding with multiple probes extending from a structure in accordance with said set spatial relationship of said different ones of said plurality of points.

3. The utility brush of claim 1, wherein said pile of bristles are attached to said exterior surface of said backing layer of said bristle sleeve via ultrasonic welding of said bristles to said exterior surface of said backing layer of said bristle sleeve.

4. The utility brush of claim 1, wherein said pile of bristles are attached to said backing layer of said bristle sleeve via weaving of said bristle material through said backing layer of said bristle sleeve.

5. The utility brush of claim 1, wherein bristle material is arranged to form a cyclic loop pattern prior to attachment of said bristle material to said exterior surface of said backing layer of said bristle sleeve, and wherein said bristle material is severed at a plurality of locations to create severed ends of said bristle material, and wherein said severed ends of said bristle material are protruding away from said backing layer and said handle.

6. The utility brush of claim 1, wherein said pile of bristles are marked via directing of ultrasonic welding energy while employing probes having customized dimensions that melt or discolor distal ends of different ones of said bristles along said backing layer.

7. The utility brush of claim 1, wherein said material of one or more of said handle and said backing layer including polypropylene includes at least 30 percent polypropylene by volume and/or by weight.

8. The utility brush of claim 1, wherein said material of one or more of said handle and said backing layer including polypropylene includes at least 50 percent polypropylene by volume and/or by weight.

9. The utility brush of claim 1, wherein said material of one or more of said handle and said backing layer including polypropylene includes at least 70 percent polypropylene by volume and/or by weight.

10. The utility brush of claim 1, wherein said material of one or more of said handle and said backing layer including polypropylene includes at least 90 percent polypropylene by volume and/or by weight.

11. The utility brush of claim 1, wherein said backing layer of said bristle sleeve is attached to said outer surface of said handle at each of said plurality of points between different adjacent ones of said pile of bristles protruding from the bristle sleeve.

12. The utility brush of claim 1, wherein said set spatial relationship is a one-dimensional array.

13. The utility brush of claim 1, wherein said set spatial relationship is a two-dimensional array.

14. The utility brush of claim 1, wherein said set spatial relationship is in accordance with a spatial interval.

15. The utility brush of claim 1, wherein two or more of said groups of said different ones of said plurality of points are along at least two different sides of the bristle sleeve when the bristle sleeve is wrapped around said handle.

16. A method for making a utility brush, including:

providing a handle having an exterior surface and being made from a material including polypropylene;

providing a bristle sleeve including a backing layer and a pile of bristles; and wherein said bristle sleeve being configured to be wrapped around said handle so that said interior surface of said bristle sleeve is in physical contact with said exterior surface of said handle; and wherein said backing layer being made from a material including polypropylene and having an interior surface and an exterior surface, and wherein said interior surface of said backing layer is configured to be attachable to said handle; and wherein said exterior surface of said backing layer is attached to said pile of bristles; and directing energy towards a plurality of points, each of said points being spatially separated from each other along said backing layer and said handle, causing heating and attachment between said exterior surface of said handle and said interior surface of said backing layer, at said points, and wherein one or more groups of different ones of said plurality of points are at a set spatial relationship with each other.

17. The method of claim 16, wherein said directing energy is performed via employment of ultrasonic welding utilizing multiple probes extending from a structure in accordance with said set spatial relationship of said different ones of said plurality of points.

18. The method of claim 16, wherein said step of providing said bristle sleeve further comprises attaching bristle material to said backing layer of said bristle sleeve via ultrasonic welding or weaving of said bristle material to or through, respectively, said backing layer to form said pile of bristles extending from said exterior surface of said backing layer.

19. The method of claim 16, wherein said plurality of points where energy is directed are each between different adjacent ones of said pile of bristles protruding from the bristle sleeve.

20. The method of claim 16, wherein two or more of said groups of said different ones of said plurality of points are along at least two different sides of the bristle sleeve when the bristle sleeve is wrapped around said handle.

* * * * *